United States Patent [19]

Veitinger

[11] 4,225,077

[45] Sep. 30, 1980

[54] CONTAINER FORMED FROM PLASTIC FOIL

[76] Inventor: Roland Veitinger, Panoramastrasse 70, 7310 Plochingen, Fed. Rep. of Germany

[21] Appl. No.: 46,070

[22] Filed: Jun. 6, 1979

[30] Foreign Application Priority Data

Jun. 13, 1978 [DE] Fed. Rep. of Germany ..... 2825837

[51] Int. Cl.[1] ..... B65D 1/26; B65D 5/46

[52] U.S. Cl. ..... 229/2.5 R; 229/45 R; 229/52 B

[58] Field of Search ..... 229/2.5 R, 2.5 EC, 45, 229/52 B

[56] References Cited

U.S. PATENT DOCUMENTS

| | | | |
|---|---|---|---|
| 2,268,906 | 1/1942 | Schfer | 229/45 X |
| 2,336,655 | 12/1943 | Tobey et al. | 229/45 X |
| 3,351,270 | 1/1967 | Hohnjec | 229/2.5 X |
| 3,421,682 | 1/1969 | Eisenbach | 229/2.5 FC X |
| 3,447,731 | 6/1969 | Lehmann | 229/2.5 EC |
| 3,650,430 | 3/1972 | Siegmar et al. | 229/2.5 R X |
| 3,786,982 | 1/1974 | Rakes et al. | 239/2.5 R |
| 3,850,365 | 11/1974 | Dietrich | 229/52 B |
| 3,933,296 | 1/1976 | Ruskin et al. | 229/2.5 R |

*Primary Examiner*—Davis T. Moorhead

*Attorney, Agent, or Firm*—Steele, Gould & Fried

[57] ABSTRACT

A container formed from plastic foil, comprising two container portions having marginal areas, and connecting parts formed in the marginal areas which can be inserted into one another, the connecting parts having the top regions formed with deformable structure, such that after the insertion, the top regions of the inner connecting parts will expand in response to a common pressing-in of the top regions, the expanded structure pressably locking respective connecting parts together.

9 Claims, 5 Drawing Figures

CONTAINER FORMED FROM PLASTIC FOIL

BACKGROUND OF THE INVENTION

The invention relates to a container formed from plastic foil, whose two container portions can be connected together by means of connecting parts formed in the marginal areas and which can be pressed into one another and co-operate in press fastener-like manner.

Such containers have long been known and have in particular proved advantageous as hygienic see-through packs for foodstuffs, e.g. fruit juice packs, for containing fruit or for passenger meals on aircraft. However, the proposal of interconnecting the two parts of a container made from a plastic foil by means of connecting parts formed in the marginal areas and which can be pressed into one another and which co-operate in press fastener-like manner has not proved satisfactory in cases in which containers formed in this way are to be used for the transportion of heavy objects, e.g. larger fruit juice packs. In such cases it is not guaranteed that the connecting parts on either side will completely satisfactorily fulfil their function of firmly interconnecting the two container parts. It has therefore already been proposed to additionally weld or stick together the two container parts, but this makes it more difficult to open the container. In addition, this measure leads to the marginal areas of the container part tearing on opening the container, which can give rise to injuries.

BRIEF SUMMARY OF THE INVENTION

The object of the invention is to provide a container of the type indicated hereinbefore with which it is also possible to transport heavier objects without there being any risk of detachment of the two container parts during transportion. However, said container must be constructed in such a way that it is possible to open the container at all times without great effort and without any risk of injury.

According to the invention this problem is solved by a container of the type described hereinbefore wherein the connecting parts inserted into one another are deformably constructed in their top region by common pressing in and wherein the inner connecting parts, at least in the vicinity of their insertion end are constructed so as to be deformable in the sense of an expansion. In the case of a container constructed in this way it is merely necessary for the firm connection of its two container parts to insert into one another the connecting parts formed in the marginal areas thereof and preferably to press more or less flat the top parts which form the "bottom" of the cup-shaped connecting part.

According to a preferred embodiment of the container of the invention its inner connecting parts have expansion deformations in the area of the insertion end to permit deformation and they are preferably inwardly directed reinforcing seams parallel to the surface line of the inner connecting part.

The associated walls of the inner and outer connecting parts of the container according to the invention are preferably constructed in axially symmetrical manner. Starting from the edge of the container portion said walls are preferably initially cylindrical and then domed, conical or truncated cone-shaped, which facilitate not only their expansion deformation, but also their manufacture.

The expansion deformation of the inner connecting part is facilitated by the fact that, according to a preferred embodiment of the container of the invention, their top area has inwardly directed reinforcing seams which preferably form a continuation of the reinforcing seams optionally provided in the surface area thereof.

According to a preferred embodiment of the container according to the invention its two container portions are interconnected in per se known manner in hinge-like manner and in their marginal portions facing the hinge-like connection have per se known handle cutouts, one container portion having a flap which engages under tabs projecting into the lower area of the handle cutout of the other container portion, which brings about an additional connection of the two container portions which can also be maintained if the remaining connecting parts of the two container portions which co-operate in press fastener-like manner are not in active engagement with one another. The above-mentioned flap preferably runs substantially at right angles to the handle cutout and forms the lower boundary thereof, which prevents injuries on the relatively sharp container edges.

BRIEF DESCRIPTION OF THE DRAWINGS

The invention is described in greater detail hereinafter relative to non-limitative embodiments and with reference to the attached drawings, wherein.

DETAILED DESCRIPTION OF THE PREFERRED EMBODIMENTS

Figure 1:
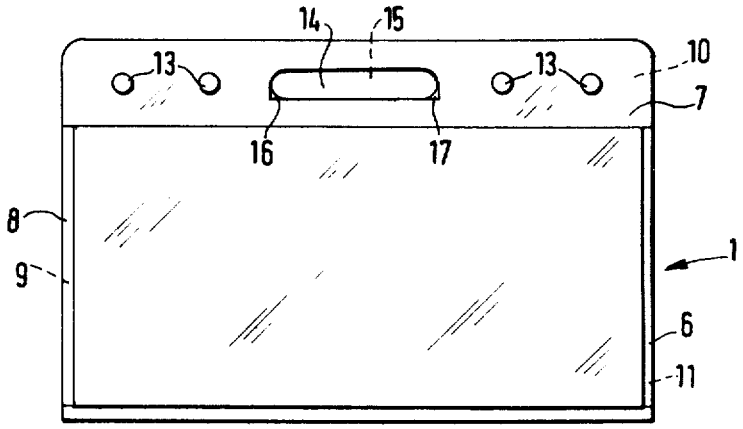
FIG. 1 is a side view of a container according to the invention.
Figure 2:
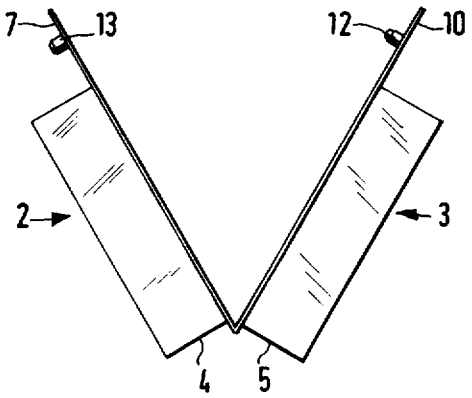
FIG. 2 is a front view of the container of FIG. 1.

In the represented embodiment the container 1 according to the invention comprises two substantially identically constructed hinge-like interconnected portions 2, 3 which in the collapsed or folded state give a box-shaped, substantially parallelpipedic container (cf FIGS. 1 and 2). The two one-piece container portions 2, 3 are made in the deep drawing process from a planar, thin and relatively rigid plastic see-through foil. The two container portions 2, 3 comprise in each case a shell, whose side walls are perpendicular to one another and to the bottom of the shell, whereby said side walls can have reinforcing ribs or a shape which stiffens them, this not being shown in the drawings. One side wall 4 of container portion 2 is connected in articulated manner with a side wall 5 of the other container portion 3. The other side walls of the two container portions have in each case edges 6 to 11 bent at right angles to the outside which engage on one another in planar manner if the two container portions 2, 3 are folded against one another. Edges 7, 10 facing the articulated connection of the two container portions 2, 3 are in each case wider than edges 6, 8 or 9, 11 adjacent to the articulated connections and have in each case a plurality of connecting parts 12, 13 (four in the present embodiment) which in the manufacture of the container parts are or thereafter are formed therefrom by the deep drawing process. The walls of these connecting parts in the represented embodiment are constructed in a substantially axially symmetrical manner and, starting from the container portion edge 7 or 10 are initially cylindrical and then truncated cone-shaped. The connecting parts 12 of one container portion 3 are dimensioned in such a way that they can be pressed into the connecting parts 13 of the other container portion 2. In addition to the above-mentioned connecting parts 12, 13 the edges 7, 10 facing the articulated connection of container portions 2, 3 have in each case a handle cutout 14, 15. Into the handle cutout 15 of edge 10 project lateral tabs 16, 17 below which engage a flap 20 projecting from below into the handle cutout 14 of edge 7 when the two container portions 2, 3 are folded against one another.

Figure 3:
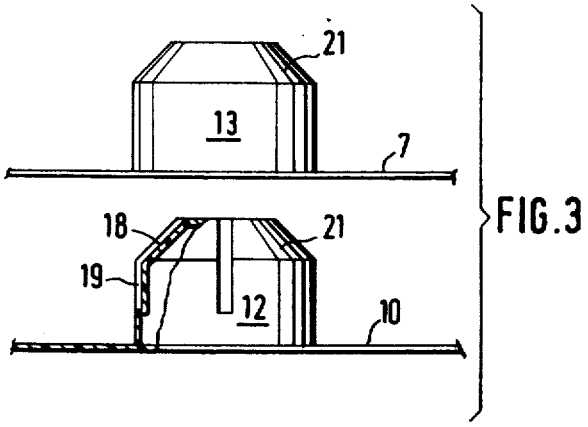
FIG. 3 is an inner connecting part and an outer connecting part associated therewith, prior to their connection.

The inner connecting portions 12 (cf FIGS. 3 and 4) have inwardly directed reinforcing seams 18 in their truncated cone-shaped top region and said seams 18 form a continuation of the also inwardly directed reinforcing seams 19 provided in the cylindrical covering thereof.

After filling one and/or the other of the two container portions with the product to be transported said portions are folded against one another ensuring that the inner connecting parts 12 which, in the represented embodiment are only provided on one container portion, but which can also be provided on both container portions are aligned with the outer connecting parts of the other container portion. Without much force having to be exerted it is then possible to insert into one another the associated connecting parts and to lock them together by slight additional pressure on the truncated cone-shaped top region 21 in the present embodiment, whereby in each case the inner connecting parts are expansion-deformed in the area of the transition between the circular cylindrical covering and the top region. This expansion is facilitated by the above-mentioned reinforcing seams 18, 19. The expansion deformations formed by the reinforcing seams can also be brought about in some other way, for example by a corrugated construction of the covering or by producing wall thickness differences in said covering.

Figure 4:
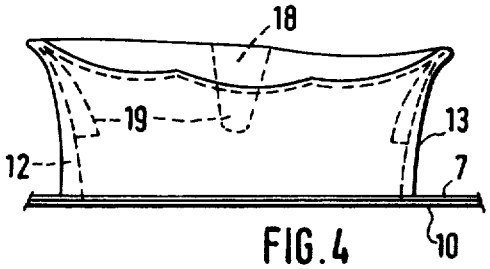
FIG. 4 is the connecting parts shown in FIG. 3 after their connection.
Figure 5:
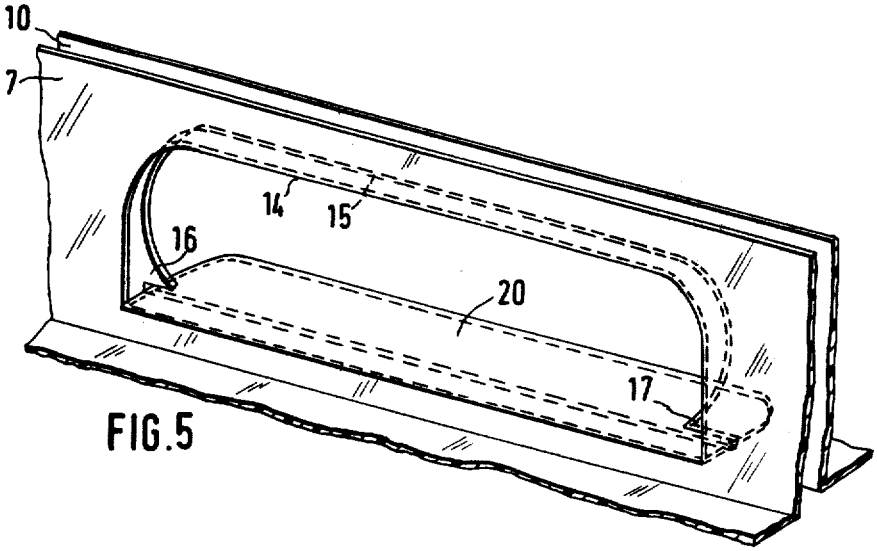
FIG. 5 is a cutaway portion of the upper container edge having a handle cutout.

The truncated cone shape of the top region 21 is particularly advantageous because, as is apparent from FIG. 4, on pressing in an internal stable position is formed, which however brings about an expansion in the marginal area of the cylindrical portion close to the top. This is inter alia achieved in that the transitions between the conical portion and the upper flat portion prevent a complete inwards snapping of the top portion. The continuation of the reinforcing seams in the area of the top portion and in particular in the area of the truncated cone-shaped portion also contributes to bringing about an expansion of the covering in which the upper area close to the top portion is larger than the base surface with which the connecting part is shaped on the edge.

It has proved particularly advantageous to shape the inner connecting parts 12 in a positive or male manner (with a punch) and the outer connecting parts 13 in a female or negative manner (in a die). As a result the wall thickness of the inner connecting part 12 is thicker in the cover area than in the outer connecting part 13, so that in the case of the inner connecting part 12 there is a particularly powerful spreading force in the upper marginal region. The thin construction of the outer connecting parts 13 makes it possible to deform them by pressing in, even without lateral reinforcing seams.

In the connection according to the invention it is mainly the spreading of the inner connecting part 12 which is important, while the cover area of the outer connecting part 13 must be pressed in so that the pressing in of the inner connecting part 12 is made possible.

The invention is not limited to the embodiments described and represented hereinbefore and various modifications can be made thereto without passing beyond the scope of the present invention.

What is claimed is:

1. A container formed from plastic foil, comprising: two container portions having marginal areas; and, connecting parts formed in the marginal areas which can be inserted into one another, the connecting parts having top regions formed with deformable structure, such that after said insertion, the top regions of the inner connecting parts will expand in response to a common pressing-in of the top regions, the expanded structure pressably locking respective connecting parts together.

2. A container according to claim 1, wherein the inner connecting parts have expansion deformations formed in the vicinity of their insertion ends to facilitate the deformable expansion thereof.

3. A container according to claim 2, wherein the expansion deformations are inwardly directed reinforcing seams running parallel to the surface line of the inner connecting parts.

4. A container according to claim 1, wherein the respective connecting parts have axially symmetrical walls.

5. A container according to claim 1, wherein the connecting parts are formed with cylindrical bottom regions, and the top regions are formed as one of domed, conical or truncated-cone shapes.

6. A container according to claim 5, wherein the inner connecting parts have inwardly directed reinforcing seams in their top region.

7. A container according to claim 6, further comprising reinforcing seams formed in the surface covering area, the reinforcing seams in the top region forming extensions thereof.

8. A container according to claim 1, wherein the two container portions are interconnected in hinge-like manner and further comprise, in their marginal region opposite the hinge-like connection, handle cutouts, one container part having tabs projecting into the lower area of the handle cutout and the other container part having a flap which engages below the projecting tabs of the other container portion.

9. A container according to claim 8, wherein the flap is substantially at right angles to the handle cutout and in the lower boundary for the latter.

* * * * *